US008467553B2

(12) United States Patent
Schefer

(10) Patent No.: US 8,467,553 B2
(45) Date of Patent: Jun. 18, 2013

(54) HEARING AID SYSTEM COMPRISING A RECEIVER IN THE EAR AND A SYSTEM FOR IDENTIFICATION OF THE TYPE OF RECEIVER

(75) Inventor: Matthias Schefer, Berne (CH)

(73) Assignee: Bernafon AG, Berne (CH)

( * ) Notice: Subject to any disclaimer, the term of this patent is extended or adjusted under 35 U.S.C. 154(b) by 393 days.

(21) Appl. No.: 12/823,742

(22) Filed: Jun. 25, 2010

(65) Prior Publication Data

US 2011/0002489 A1 Jan. 6, 2011

Related U.S. Application Data

(60) Provisional application No. 61/223,242, filed on Jul. 6, 2009.

(30) Foreign Application Priority Data

Jul. 3, 2009 (EP) ..... 09164523

(51) Int. Cl.
*H04R 25/02* (2006.01)
*H04R 29/00* (2006.01)
*H04R 25/00* (2006.01)

(52) U.S. Cl.
USPC ..... 381/312; 381/314; 381/330; 381/60

(58) Field of Classification Search
USPC ..... 381/312, 314, 330, 381, 60, 320, 381/321, 316
See application file for complete search history.

(56) References Cited

U.S. PATENT DOCUMENTS

| | | | | |
|---|---|---|---|---|
| 5,812,598 | A * | 9/1998 | Sharma et al. | 375/259 |
| 6,269,318 | B1 * | 7/2001 | Geddes | 702/109 |
| 7,286,678 | B1 * | 10/2007 | Bachler et al. | 381/314 |
| 7,890,284 | B2 * | 2/2011 | Patterson et al. | 702/117 |
| 7,949,144 | B2 * | 5/2011 | Harsch et al. | 381/312 |
| 8,189,829 | B2 * | 5/2012 | Vonlanthen | 381/312 |
| 2002/0026091 | A1 * | 2/2002 | Leysieffer | 600/25 |
| 2003/0086582 | A1 * | 5/2003 | Vonlanthen | 381/322 |
| 2006/0004930 | A1 * | 1/2006 | Patino et al. | 710/16 |
| 2008/0008340 | A1 * | 1/2008 | Bachler et al. | 381/314 |
| 2009/0028364 | A1 * | 1/2009 | Vonlanthen | 381/312 |
| 2009/0052706 | A1 * | 2/2009 | Gottschalk et al. | 381/314 |
| 2009/0103754 | A1 * | 4/2009 | Gottschalk et al. | 381/312 |
| 2010/0111315 | A1 * | 5/2010 | Kroman | 381/60 |
| 2010/0208906 | A1 * | 8/2010 | Vonlanthen | 381/60 |
| 2010/0272272 | A1 * | 10/2010 | Muller et al. | 381/60 |

FOREIGN PATENT DOCUMENTS

| | | | |
|---|---|---|---|
| WO | WO 99/09799 | A2 | 3/1999 |
| WO | WO 02/11509 | A1 | 2/2002 |
| WO | WO 2007/045254 | A1 | 4/2007 |
| WO | WO 2007/144010 | A1 | 12/2007 |
| WO | WO 2009/065742 | A1 * | 5/2009 |
| WO | WO 2009/065742 | A1 | 5/2009 |

* cited by examiner

*Primary Examiner* — Edgardo San Martin
(74) *Attorney, Agent, or Firm* — Birch, Stewart, Kolasch & Birch, LLP

(57) ABSTRACT

A hearing aid system may include a behind-the-ear (BTE) part configured to be located at an ear of a user, an in-the-ear (ITE) part configured to be located in an ear canal of a user, and a measurement circuit. The ITE part may include a receiver for converting an electric output signal having frequencies in the human audible frequency range to an output sound, and a resistive identification element. The measurement circuit is configured to measure an identification parameter indicative of the resistance of the resistive identification element, thus identifying the ITE part. The measurement circuit uses the same electric output signal that is driving the receiver to determine the identification parameter. Advantageously, this approach does not require an additional signal, such as DC voltage, to determine the identification parameter.

14 Claims, 3 Drawing Sheets

HEARING AID SYSTEM COMPRISING A RECEIVER IN THE EAR AND A SYSTEM FOR IDENTIFICATION OF THE TYPE OF RECEIVER

This Non-provisional application claims priority under 35 U.S.C. §119(e) on U.S. Provisional Application No(s). 61/223,242 filed on Jul. 6, 2009, and under 35 U.S.C. 119(a) to European Patent Application No. 09164523.4 filed on Jul. 3, 2009 all of which are hereby expressly incorporated by reference into the present application.

TECHNICAL FIELD

The present invention relates to listening devices, e.g. to hearing instruments comprising a receiver located in the ear canal of a user.

The invention furthermore relates to a method of identifying a type of receiver in a hearing aid system and to the use of a hearing aid system.

The invention may e.g. be useful in applications such as listening devices comprising exchangeable receivers.

In the present context, a hearing aid (also termed a hearing instrument) may be of any appropriate kind, such as an in-the-ear (ITE), such as an in-the-canal (ITC), such as a completely-in-canal (CIC), such as a behind-the-ear (BTE), or such as a receiver-in-the-ear (RITE) hearing aid. The present invention is, however, particularly relevant for a RITE-type hearing instrument.

BACKGROUND ART

The following account of the prior art relates to one of the areas of application of the present invention, hearing instruments.

Hearing aids with a so-called open fitting having an ITE-part comprising a receiver located in the ear canal (RITE) and a BTE-part comprising a processing part located behind the ear have become increasingly used. Each BTE-part may be connectable to a number of different ITE-parts. Various methods of identifying and distinguishing these RITE modules have been proposed to ensure that a given combination of BTE- and RITE-modules will not impose damage and/or produce uncomfortable sound levels to the end user (e.g. due to the connection of a RITE module with higher sensitivity or maximum output power than actually intended, e.g. as determined during fitting).

WO 02/11509 describes a hearing device comprising a first module with an electrical supply as well as an electrical to mechanic output converter and a second module with a signal processing unit as well as an acoustical/electrical input converter. In an embodiment, the hearing device comprises a code unit in said first module and a code-reader and decoding unit in said second module.

WO 99/09799 deals with a hearing aid with a central signal processing unit, which interacts with peripheral units on the input and output side. The peripheral units each have an identification unit whose output interacts with the input of a comparing unit. The comparing unit in turn interacts with identification-possibility memory units, and acts on a configuration storage unit on the output side. In this way, the hearing aid configuration can identify itself using the peripheral units.

WO 2007/045254 A1 describes an interchangeable acoustic system for a hearing aid, where the acoustical system is adapted for conducting sound from an output transducer in the hearing aid housing of the hearing aid to an ear of a user, and where the interchangeable acoustic system comprises an encoding indicating acoustical properties of the interchangeable acoustic system. In an embodiment, the interchangeable acoustic system comprises an adapter for attaching the interchangeable acoustic system to a hearing aid housing of a hearing aid, and wherein said encoding comprises at least one electrically conductive area arranged in connection with the adapter and where the electrically conductive area has a resistance value indicating the acoustical properties of the system.

WO 2009/065742 A1 describes a hearing aid comprising a signal processing device, a receiver connected to the signal processing device and a microphone connected to the signal processing device, whereby the signal processing device is electrically coupled to a connection socket operable to detachably connect the receiver to the socket, and whereby the signal processing device further comprises a detector operable to detect a characteristics of the receiver which is connected to the signal processing device through the connection socket. In an embodiment, a characteristic of the receiver is a characteristic parameter of an additional element included in the receiver, such as a capacitor or a resistor or any other electronic element.

US 2009/00521706 describes a hearing aid system, which comprises an automatic identification of the type of receiver used. Further, automatic adaptation of the signal processing in the hearing aid device is provided according to the type of receiver identified by the hearing aid system. Incorrect manual adaptation is thereby prevented. In an embodiment, different resistors are associated with different types of receivers, and the respective type of receiver used in the hearing aid device is able to be identified by the value of the resistor.

DISCLOSURE OF INVENTION

An object of the present invention is to provide a relatively simple scheme for identifying a receiver in a hearing aid system.

Objects of the invention are achieved by the invention described in the accompanying claims and as described in the following.

A Hearing Aid System:

An object of the invention is achieved by a hearing aid system comprising a BTE-part adapted for being located at an ear of a user and an ITE-part adapted to be located in an ear canal of a user, the ITE-part comprising a receiver for converting an electric output signal comprising frequencies in the human audible frequency range to an output sound, the ITE-part further comprising a resistive ID-element, the hearing aid system comprising a measurement circuit for measuring an ID-parameter indicative of the resistance of said resistive ID-element, wherein said measurement circuit is adapted to use said electric output signal to determine said ID-parameter. An advantage of the invention is that it utilizes the electric output signal used for driving the receiver (speaker). It does NOT require an additional signal, for example a DC voltage, in order to determine the ID-parameter. This reduces the complexity of the circuitry and/or the firmware running in the hearing instrument. Furthermore, the detection can be done anytime where an output signal is present in the hearing aid system.

Typically, the resistive ID-element does not contribute to the function of the receiver, other than to the identification of its type. In an embodiment, the resistive ID-element is a separate resistor (i.e. the resistive ID-element is uncorrelated to the impedance of the receiver). In an embodiment, the resistive ID-element is applied to the receiver for the sole purpose of identification of the type of receiver. In an embodiment, the ID-parameter is equal to the resistance of the resistive ID-element. In an embodiment, the ID-parameter is equal to a (possibly effective) voltage measured over the resistive ID-element with a known (possibly effective) current through the resistive ID-element. In an embodiment, the ITE-part comprises two identical resistive ID-elements.

In an embodiment, the resistive ID-element is electrically connected to the electric output signal. In an embodiment, the two identical resistive ID-elements are electrically connected to each their electric output signal of a differentially driven receiver.

In a particular embodiment, the measurement circuit comprises a level detecting element. In a particular embodiment, the measurement circuit comprises a peak detecting element. In a particular embodiment, the measurement circuit comprises a diode. In a particular embodiment, the measurement circuit comprises a diode in series with the resistive ID-element. In an embodiment, the diode form part of the ITE-part. In an embodiment, the diode form part of the BTE-part. In an embodiment, the diode form part of a connecting device, e.g. a programming device for use during fitting of the hearing instrument.

The electric output signal for driving the receiver comprises frequencies in the human audible frequency range, e.g. between 20 Hz and 20 kHz, typically some sub-range thereof. Additionally, the signal may comprise frequency components at higher frequencies, e.g. due to modulation of the signal. In an embodiment, the measurement circuit comprises a high frequency level detecting element adapted for detecting the level of such frequency components at higher frequencies (e.g. in the order of hundreds of kHz, e.g. around 500 kHz). In an embodiment, the level(s) of the frequency components at higher frequencies is used to determine the ID-parameter indicative of the resistance of the resistive ID-element.

In a particular embodiment, the electric output signal is a difference signal. In the present context, a difference signal is intended to indicate that the two conductors that are electrically connected to the receiver for carrying the signals driving the receiver are fed with each their individual time varying signal, so that the resulting signal stimulating the receiver is the difference between the two signals. In a particular embodiment, the electric output signal is a true differential signal, where the two signals driving the receiver are each others inverse. In a particular embodiment, the electric output signal is a modulated signal. In a particular embodiment, the electric output signal is a modulated difference signal. In an embodiment, the electric output signal(s) is/are digital. In a particular embodiment, the electric output signal is a pulse width modulated signal (cf. e.g. U.S. Pat. No. 5,812,598 A).

In a particular embodiment, the measurement circuit is adapted to be symmetric with respect to the difference signal driving the receiver. In an embodiment both conductors driving the receiver are equally loaded by the measurement circuit (e.g. each being connected to identical resistive ID-elements, etc.).

In a particular embodiment, the measurement circuit comprises a voltage measurement unit for measuring a voltage related to the resistance of said resistive ID-element. In a particular embodiment, the measurement circuit comprises an analogue to digital converter for measuring a voltage level. This has the advantage that NO firmware is required because the voltage from the ADC can be directly used to identify the receiver (either by the DSP of the hearing aid itself or by a fitting software, when the hearing aid is connected to a device running such software, cf. e.g. FIG. 2). In an embodiment, the measurement is averaged over a predefined time.

In a particular embodiment, the hearing aid system comprises an interface to a programming device, e.g. to a device for running fitting software for fitting the hearing instrument to a particular user's needs. In a particular embodiment, the interface is wireless and comprises adequate transceiver and antenna components.

In a particular embodiment, the measurement circuit comprises a resistive reference element. In a particular embodiment, the measurement circuit comprises a capacitor in parallel with the resistive reference element. In a particular embodiment, the measurement circuit is adapted to perform a voltage measurement at a node to which the resistive reference element is connected. In a particular embodiment, the measurement circuit is adapted to perform a voltage measurement at a node to which the output of the level or peak detecting element is connected.

In a particular embodiment, the resistance of the resistive ID-element is indicative of the type of said receiver (reflecting intended technical specifications). The present invention addresses the problem of identification of different types of receivers. The term type is used to mean characteristics of a receiver possibly selected among a larger number of individual items, which are intended to have the same properties. A type of a receiver can e.g. be characterized by its intended technical specifications, such as its input sensitivity and/or max output volume. The term type of a receiver is on the other hand not intended to provide a unique identification of the individual receiver (such as its individual detailed frequency response).

In a particular embodiment, the resistance of the resistive reference element and the resistance of the resistive ID-element of one particular type of receiver are of the same order, e.g. in the kΩ-range, e.g. around 300 kΩ.

Use:

Use of a hearing aid system described above, in the detailed description of 'mode(s) for carrying out the invention' and in the claims is moreover provided by the present invention.

A Method of Identifying a Type of Receiver:

A method of identifying a type of receiver in an hearing aid system, the hearing aid system comprising a BTE-part adapted for being located at an ear of a user and an ITE-part adapted to be located in an ear canal of a user, the ITE-part comprising a receiver for converting an electric output signal comprising frequencies in the human audible frequency range to an output sound, the ITE-part further comprising a resistive ID-element is furthermore provided by the present invention. The method comprises measuring an ID-parameter indicative of the resistance of said resistive ID-element using said electric output signal to determine said ID-parameter.

In a particular embodiment, the electric output signal is a difference signal.

In an embodiment, measurement is performed based on a predefined sound input. In an embodiment, the predefined sound input provides a relatively constant input sound level. In an embodiment the input level is relatively constant over frequency. In an embodiment, the signal processor is adapted to provide a specific electric output signal, which is suitable for performing the measurement of the ID-parameter.

In an embodiment, a measurement of the resistance of the ID-element $R_{ID}$ of the receiver is performed at the initiative of the user of the hearing aid (e.g. via an external input, e.g. via a remote control unit). In an embodiment, a measurement is initiated via a fitting software, when a connection to a programming device (e.g. a PC) running such fitting software is established, cf. e.g. FIG. 2. In an embodiment, a measurement is made during boot of the hearing instrument (i.e. when the instrument is turned on or powered up).

It is intended that the structural features of the system described above, in the detailed description of 'mode(s) for carrying out the invention' and in the claims can be combined with the method, when appropriately substituted by a corresponding process and vice versa. Embodiments of the method have the same advantages as the corresponding systems.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

FIG. 1 shows different embodiments of a hearing aid system according to the invention.

Figure 1A:
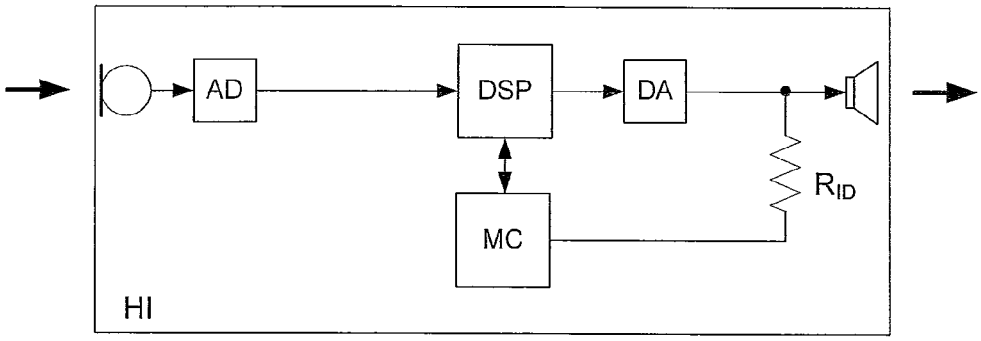
FIG. 1 shows different embodiments of a hearing aid system according to the invention.
Figure 1B:
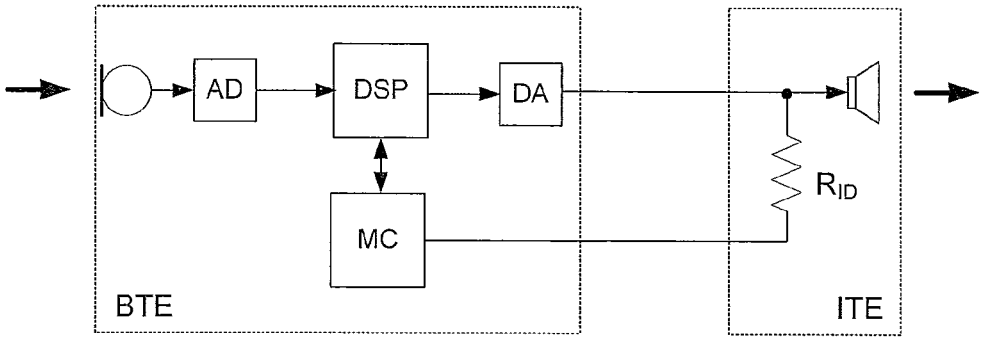
Figure 1C:
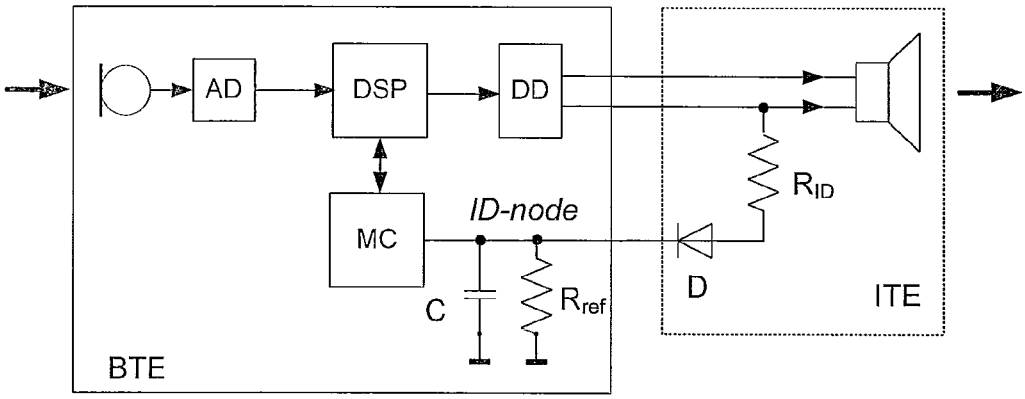

FIG. 1 shows embodiments of a hearing aid system comprising a microphone and a receiver, an electrical forward path being defined there between. In the embodiments of FIG. 1, the forward path further comprises an analogue to digital converter (AD) for digitizing an analogue input signal from the microphone, a signal processor (DSP) for processing the digitized input signal (possibly in a number of frequency bands) and providing a processed output signal (typically with a frequency dependent gain adapted to a particular user's needs) and a digital to analogue converter (DA, FIGS. 1*a*, 1*b*) providing an analogue output signal or a digital to digital converter (DD, FIG. 1*c*) for providing a specific digital output signal for driving the receiver. The hearing aid system further comprises an additional resistor $R_{ID}$ for characterizing the type of receiver and a measurement circuit (comprising a measurement unit, MC) for identifying the type of receiver by measuring an ID-parameter (e.g. a voltage) indicative of the value of the resistance of the resistor $R_{ID}$. The resistor $R_{ID}$ is electrically connected to the electrical output signal fed to the receiver. The measured ID-parameter (or the value of the resistance of $R_{ID}$) is e.g. fed to the signal processor DSP as indicated by the electrical connection between the DSP and MC units. The hearing aid system may be adapted to provide that a measurement is initiated by the signal processor, e.g. automatically in specific situations, e.g. during power-up/boot of the system. In the embodiment of FIG. 1*a*, all elements of the hearing aid system are located in a hearing instrument (HI) as indicated by the solid enclosure. The functional parts of the hearing instrument may e.g. be partitioned in separate physical units (e.g. a BTE-part and an ITE-part), each having their independent structural parts (e.g. housing). Alternatively, all parts may be located in the ITE-part or the functional parts may be partitioned in any other meaningful way. Two physically separate parts can e.g. be connected by an acoustical, electrical or optical wired or wireless connection. In the embodiment of FIG. 1*b*, a partition of the system into a BTE-part adapted to be located at or behind an ear of a person and an ITE-part adapted to be located in an ear canal of the person is shown, the two parts being electrically connected (e.g. via a wired connection or, alternatively, via a wireless link comprising corresponding transmit and receive circuitry). The BTE-part comprises the microphone, the processing and measurement circuits, whereas the ITE-part comprises the receiver and the resistive ID-element $R_{ID}$. The BTE- and ITE-parts are indicated by respective dotted rectangular enclosures.

In the embodiment of FIG. 1*c*, which is partitioned as the embodiment in FIG. 1*b* in a BTE- and an ITE-part, the measurement circuit comprises a diode D, which in the present embodiment is located in the ITE-part (it could alternatively be located in the BTE-part) and connected in series with the resistive ID-element $R_{ID}$. In the embodiment of FIG. 1*c*, the measurement circuit further comprises a capacitance C in parallel with reference resistor $R_{ref}$, one terminal being connected to a system ground, the other terminal to an ID-node connecting to the output of the diode D. Both components C, $R_{ref}$ are (in the present embodiment) located in the BTE-part. The measurement unit MC (e.g. a volt meter, e.g. a 5-bit analogue to digital converter) measures the voltage $V_{DC}$ of the ID-node. The voltage $V_{DC}$ represents a division of the (positive) voltage $V_{r1}$ of (at least) one of the output signals fed to the receiver over the resistive ID-element $R_{ID}$, the diode D and the reference resistor $R_{ref}$. ($V_{DC}=V_{r1}\cdot R_{ref}/(R_{ref}+R_D+R_{ID})$), where $R_D$ is the (preferably small) diode resistance. In the embodiment of FIG. 1*c*, the receiver is driven by a difference signal generated by the digital to digital converter (DD). In an embodiment, the difference signal comprises a (HF) frequency component above the human audible frequency range intended to be presented to a user as an output sound via the receiver. The diode D and capacitor C act as a rectifier of the HF component from the DD converter resulting in a DC voltage at the input to the measurement unit (MC). The resistors $R_{ref}$ and $R_{ID}$ (largely) define the voltage, whereby $R_{ID}$ (and thus the receiver type) can be determined.

Figure 3A:
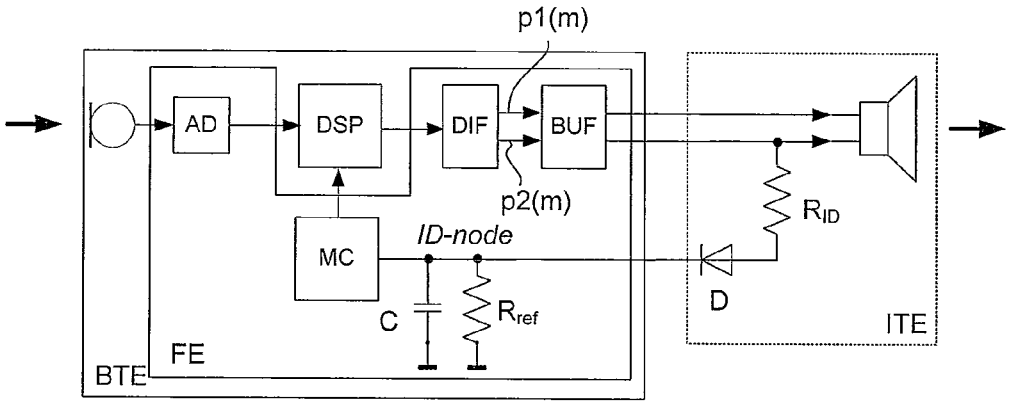
FIG. 3 shows an embodiment of a hearing aid system according to the invention (FIG. 3*a*) and an exemplary electric output signal for driving the receiver and for use in a measurement of the ID-resistor (FIG. 3*b*).
Figure 3B:
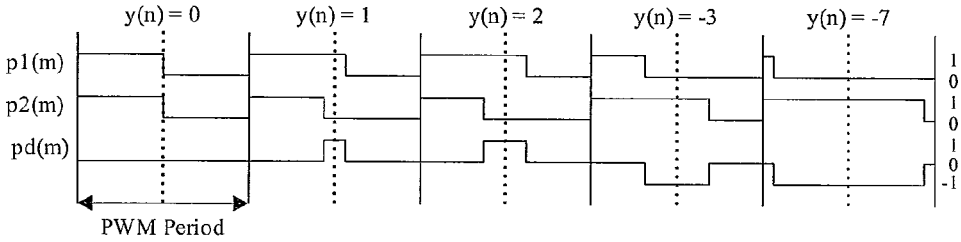

In an embodiment, the electric output signal from the DD converter to the receiver is pulse width modulated (see FIG. 3*b* and corresponding description).

EXAMPLE

In an embodiment, $R_{ref}$ is chosen to 330 kOhm, the capacitor C to 1 nF, and the resistive ID-element $R_{ID}$ takes on a number of appropriate values relative to $R_{ref}$. The values of $R_{ID}$ are further chosen with a view to the number of different receiver types to be selectively identified, to the tolerances of the resistors used (isolated resistor components (typically having small tolerances) or resistors implemented on an integrated circuit (typically having large tolerances)), etc. In an embodiment, the diode is of a 1N4148 type. A Schottky diode is preferably used, whereby the diode losses can be reduced.

| $R_{ref}$ | $R_{ID}$ | $V_{DC}$ (measured) | $V_{DC}$ (simulated) |
|---|---|---|---|
| 330 kΩ | 9.7 kΩ | 856 mV | 890 mV |
| 330 kΩ | 330 kΩ | 254 mV | 260 mV |

The detected DC voltage $V_{DD}$ does not depend on the receiver sound level output, because the driving signal is pulse width modulated and has a constant amplitude of 1.3 V. An advantage of the method is that a measurement can be made even when the instrument is muted, since the HF component (e.g. 480 kHz) is present also in this case.

The maximum current drawn by the measurement circuit is less than 3 μA.

Figure 2A:
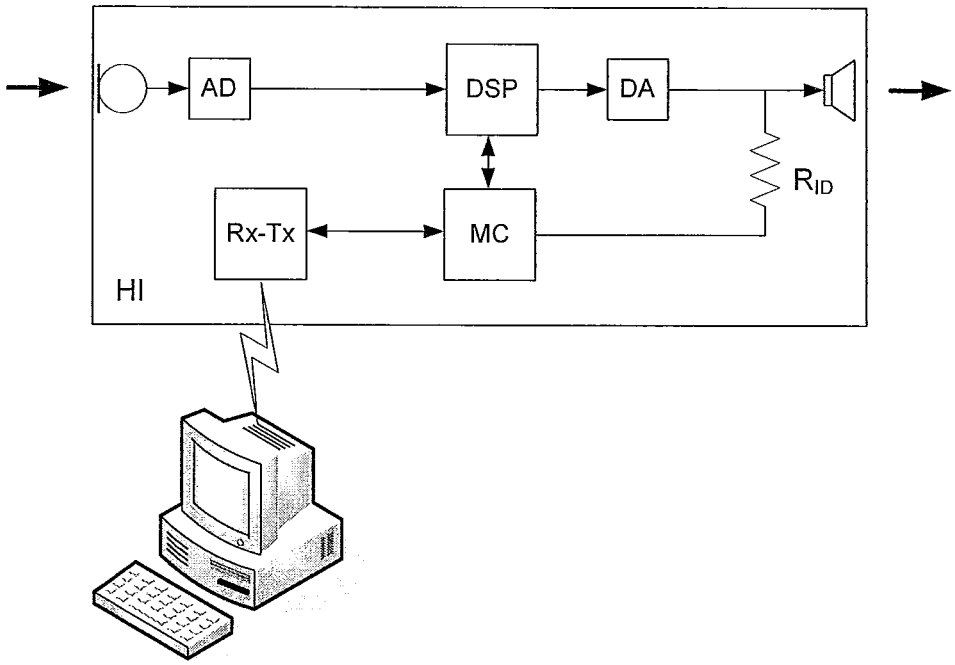
FIG. 2 shows an embodiment of a hearing aid system according to the invention connected to a PC (FIG. 2*a*) and an embodiment comprising a PC (FIG. 2*b*)
Figure 2B:
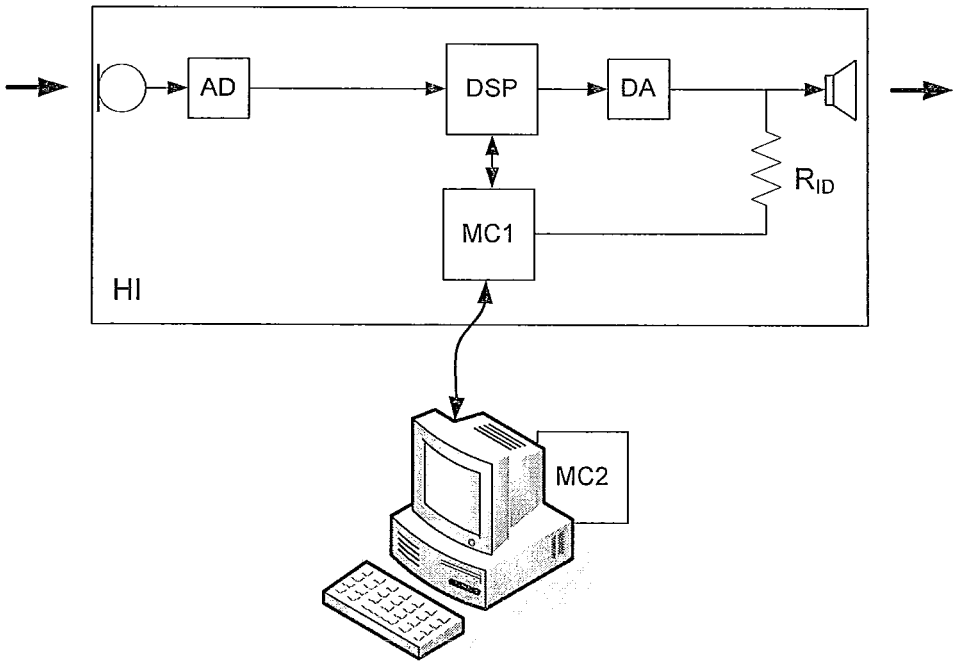

FIG. 2 shows an embodiment of a hearing aid system according to the invention connected to a PC (FIG. 2*a*) and an embodiment comprising a PC (FIG. 2*b*). FIG. 2 illustrates a situation where the measurement to identify the resistance value of the ID-resistor (and thus the type of receiver) is made or at least displayed using a PC or other device comprising appropriate processing power, display and I/O-units, e.g. a programming device for the fitting of a hearing instrument to a particular user's needs. In the scenario of FIG. 2*a*, the measurement is performed by the hearing instrument and only a resulting voltage or resistance value is transferred to the fitting software (PC) and displayed to an operator, e.g. an audiologist, who can take appropriate action depending on the result of the ID-measurement. The communication between the hearing instrument and the PC can be of any appropriate kind, wired or wireless. In FIG. 2*a* a wireless connection is indicated, the hearing instrument (HI) and the programming device (PC) comprising appropriate transceiver circuitry and antennas (cf. Rx-Tx-unit indicated in the HI). In the scenario of FIG. 2*b*, the measurement is performed by the hearing instrument and the connected PC in combination, e.g. in a fitting situation, as indicated by the distributed location of the measurement unit (MC1 in the hearing instrument and MC2 in the PC). In an embodiment, the measurement circuit is fully integrated into the programming device (PC), so that the part of the measurement circuit MC1 in the hearing instrument only represents an electrical connection to the resistive ID-element $R_{ID}$. In an embodiment, all components of the measurement circuit, except the level or peak detecting element (e.g. the diode), are integrated into the programming device (PC). In FIG. 2*a* a wired connection is indicated between the hearing instrument and the PC. In both cases the hearing instrument can be embodied as shown in FIGS. 1*a*, 1*b*, or 1*c* (or any other way falling within the scope of the invention).

FIG. 3 shows an embodiment of a hearing aid system according to the invention (FIG. 3*a*) and an exemplary electric output signal for driving the receiver and for use in a measurement of the ID-resistor (FIG. 3*b*). In the embodiment of FIG. 3, the electric output signal is a difference signal that is modulated by using a pulse width modulation (PWM) technique (cf. e.g. U.S. Pat. No. 5,812,598 A). The two signals feeding each terminal of the receiver are modulated to provide that their difference represent digital values m of the output signal between a minimum value $N_{min}$ and a maximum value $N_{max}$. In an embodiment, $N_{min}=-8$ and $N_{max}=+8$. Each number m (e.g. representing the value of the output signal at a specific point in time) is represented in a PWM-period comprising 16 (clock) periods by a positive (e.g. +1, +2, . . . , +8) or negative pulse (e.g. −1, −2, . . . , −8) centred around the middle of the PWM-period, each number being represented by a specific pulse width (the width being e.g. proportional to the absolute value of m, cf. the example in FIG. 3*b* illustrating the individual signals p1(*m*), p2(*m*) and their difference pd(m)=p1(*m*)−p2(*m*) for m=y(n)=0, +1, +2, −3, −7). In the embodiment of the system illustrated in FIG. 3*a*, the hearing instrument comprises a BTE part adapted for being located at or behind an ear of a user and an ITE part adapted for being located in an ear canal of a user (as indicated by the rectangular enclosures BTE (solid) and ITE (dotted)). The ITE part comprises a receiver for presenting an output signal to a user. The receiver receives its input signals from the BTE-part as a difference signal (here pulse width modulated), the resulting signal being a difference between the two input signals to the receiver. One of the input signals is connected to a first terminal of the ID-resistor having a resistance $R_{ID}$ that identifies the type of receiver. The second terminal of the ID-resistor is connected to the positive terminal of a diode D, whose negative terminal is connected to the measurement unit of the BTE-part. The connection between the BTE and ITE parts of the embodiment of FIG. 3*a* thus has 3 electrical conductors and can be made by standard 3-pin connectors, e.g. of the plug and socket type (e.g. CS43 from Pulse Engineering Inc.). The BTE-part comprises a microphone connected to an AD-converter (AD), which is connected to a signal processor (DSP), whose output is fed to a DD-converter (cf. FIG. 1*c*) comprising a modulation unit (DIF) for generating the pulse modulated difference signals p1(*m*), p2(*m*) and a buffer unit (BUF) which buffers the difference signals p1(*m*), p2(*m*) and feeds the buffered signals to the receiver of the ITE-unit via an appropriate connecting element. The BTE-part further comprises a capacitance C in parallel with reference resistor $R_{ref}$, one terminal being connected to a system ground, the other terminal to an ID-node connecting to the output of the diode D of the ITE part via the connecting element. The measurement unit MC (e.g. comprising an AD-converter) measures the voltage of the ID-node which is indicative of the resistance of the ID-element $R_D$. The result is fed to the signal processing unit for further evaluation and check (e.g. that the receiver type is as expected). In case the receiver type is not the expected one, the signal processor (DSP) can be adapted to issue an error message (e.g. an acoustic message to the user and/or a text message to a fitting program, in case a connection to a PC running such fitting software is established, cf. e.g. FIG. 2) and/or power down the device.

In the embodiment of FIG. 3*a*, a partition of the functional components of the BTE-part in two parts is shown. One part, the DSP, represents the mainly digital parts of the BTE-part.

The other part, denoted FE (Front End) and being indicated by the U-formed solid enclosure, comprises the mainly analogue circuitry. The components may be implemented as two different integrated circuits (ICs). In an embodiment, the reference resistor $R_{ref}$ and/or capacitor C components are implemented as separate components (separate from the IC). This has the advantage of improving the precision with which their component values can be chosen. Thereby the different $R_{ID}$ values can be chosen closer to each other and thus the number of different types of receivers covered by a specific measurement circuit can be larger.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

WO 02/11509 A1 (PHONAK) Feb. 14, 2002
WO 99/09799 A2 (PHONAK) Mar. 4, 1999
WO 2007/045254 A1 (WIDEX) Apr. 26, 2007
WO 2009/065742 A1 (OTICON, BERNAFON) May 28, 2009
US 2009/00521706 A1 (SIEMENS AUDIOLOGISCHE TECHNIK) Feb. 26, 2009
U.S. Pat. No. 5,812,598 A (Phonic Ear) Sep. 22, 1998

The invention claimed is:

1. A hearing aid system comprising
a BTE-part adapted for being located at an ear of a user and
an ITE-part adapted to be located in an ear canal of a user, the ITE-part comprising
a receiver for converting an electric output signal comprising frequencies in the human audible frequency range to an output sound,
the ITE-part further comprising a resistive ID-element,
the hearing aid system comprising a measurement circuit for measuring an ID-parameter indicative of the resistance of said resistive ID-element, wherein
said measurement circuit is adapted to use said electric output signal to determine said ID-parameter.

2. A hearing aid system according to claim 1 wherein the measurement circuit comprises a level detecting element.

3. A hearing aid system according to claim 1 wherein the measurement circuit comprises a high frequency level detecting element.

4. A hearing aid system according to claim 1 wherein the measurement circuit comprises a diode.

5. A hearing aid system according to claim 1 wherein the measurement circuit comprises a diode in series with said resistive ID-element.

6. A hearing aid system according to claim 1 wherein the electric output signal is a difference signal.

7. A hearing aid system according to claim 1 wherein the measurement circuit comprises a voltage measurement unit for measuring a voltage related to the resistance of said resistive ID-element.

8. A hearing aid system according to claim 1 wherein the measurement circuit comprises a resistive reference element.

9. A hearing aid system according to claim 8 wherein the measurement circuit comprises a capacitor in parallel with said resistive reference element.

10. A hearing aid system according to claim 1 wherein the resistance of said resistive ID-element is indicative of the type of said receiver.

11. A method of identifying a type of receiver in an hearing aid system, the hearing aid system comprising a BTE-part adapted for being located at an ear of a user and an ITE-part adapted to be located in an ear canal of a user, the ITE-part comprising a receiver for converting an electric output signal comprising frequencies in the human audible frequency range to an output sound, the ITE-part further comprising a resistive ID-element, the method comprising
measuring an ID-parameter indicative of the resistance of said resistive ID-element,
using said electric output signal to determine said ID-parameter.

12. A method according to claim 11 wherein the electric output signal is a difference signal.

13. A method according to claim 11 wherein the measurement is performed based on a predefined sound input.

14. A method according to claim 11 wherein the signal processor is adapted to provide a specific electric output signal, which is suitable for performing the measurement of the ID-parameter.

* * * * *